US006117494A

United States Patent [19]

Wakat

[11] Patent Number: 6,117,494

[45] **Date of Patent: *Sep. 12, 2000**

[54] PAINT ROLLER METHOD AND APPARATUS

[75] Inventor: George H. Wakat, St, Paul Park, Minn.

[73] Assignee: Wagner Spray Tech Corporation, Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/827,752

[22] Filed: Apr. 11, 1997

[51] Int. Cl.[7] ..... B05D 1/28; B05C 1/08

[52] U.S. Cl. ..... 427/428; 118/258; 118/264; D4/122; 220/570; 492/13

[58] Field of Search ..... 427/428; 118/258, 118/264; D4/122, 123; 492/13, 14; 220/570

[56] References Cited

U.S. PATENT DOCUMENTS

| | | | |
|---|---|---|---|
| D. 220,850 | 6/1971 | Davis | D64/18 |
| 2,321,511 | 6/1943 | Piercy . | |
| 2,371,948 | 3/1945 | Bergmann . | |
| 2,680,873 | 6/1954 | Ernst . | |
| 2,735,128 | 2/1956 | Adams . | |
| 2,838,781 | 6/1958 | Molle . | |
| 2,955,309 | 10/1960 | Brown, Jr. . | |
| 3,102,327 | 9/1963 | Wiegand | 492/13 |
| 3,562,837 | 2/1971 | Baginski et al. . | |
| 3,745,624 | 7/1973 | Newman | 29/116 R |
| 3,970,396 | 7/1976 | Brady . | |
| 4,102,468 | 7/1978 | Goldman | 220/69 |
| 4,191,792 | 3/1980 | Janssen | 427/260 |
| 4,434,521 | 3/1984 | Martin et al. | 15/230.11 |
| 4,467,509 | 8/1984 | Dezen | 29/116 R |
| 4,897,893 | 2/1990 | Barker | 15/230.11 |
| 4,937,909 | 7/1990 | Georgiou | 15/230.11 |
| 5,117,529 | 6/1992 | Ohta | 15/230.11 |
| 5,167,055 | 12/1992 | Stoddart et al. | 29/110.5 |
| 5,178,274 | 1/1993 | Long | 206/361 |
| 5,206,979 | 5/1993 | Campbell | 492/13 |
| 5,471,703 | 12/1995 | Niven | 15/230.11 |
| 5,571,562 | 11/1996 | Wakat | 427/280 |
| 5,713,095 | 2/1998 | Wakat | 15/230.11 |
| 5,966,772 | 10/1999 | Woodnorth et al. | 15/230.11 |

FOREIGN PATENT DOCUMENTS

| | | |
|---|---|---|
| 2 332 677 | 1/1974 | Germany . |
| 3616114 | 11/1987 | Germany . |
| 80213 | 12/1952 | Norway . |
| 191483 | 9/1937 | Switzerland . |
| 6944228 | 12/1979 | U.S.S.R. . |
| 2 172 820 | 10/1986 | United Kingdom . |

OTHER PUBLICATIONS

Harrington, L., et al., "Color : A Stroke of Brilliance; A Guide to Color & Decorating with Paint", Benjamin Moore & Co., Montvale, N.J., 104–107, (1993).

*Primary Examiner*—Shrive Beck
*Assistant Examiner*—Michael Barr
*Attorney, Agent, or Firm*—Faegre & Benson LLP

[57] ABSTRACT

A roller apparatus for applying paint includes a frame. The frame has a continuous axle on which a first roller cover holder and a second roller cover holder are attached. A spacer is attached to said axle between the first roller cover holder and the second roller cover holder. The spacer maintains a distance between said first roller cover and said second roller cover. The roller apparatus is used with a multi-well paint pan. The paint pan will have at least as many wells as roller cover holders on the roller apparatus. The paint pan may have more wells than the number of roller cover holders on the roller apparatus. The spacer is small enough so that the roller covers on the roller cover holders are capable of accessing the wells in the paint pan. The spacers also maintain the spacing between the roller covers on the axle of the roller apparatus so that each of the roller covers can be placed in a well of the multi-well paint pan at the same time or substantially simultaneously.

18 Claims, 3 Drawing Sheets

PAINT ROLLER METHOD AND APPARATUS

RELATED APPLICATIONS

The present invention is related to U.S. patent application Ser. No. 08/838,860, entitled "PAINTING APPARATUS AND ASSEMBLY" which is assigned to a common assignee and filed on a date even herewith.

FIELD OF THE INVENTION

The present invention relates generally to paint rollers. In particular, the present invention relates to paint rollers for use with a painting tray for holding several paints in separate chambers.

BACKGROUND OF THE INVENTION

Paint rollers are well known in the art as a fast and convenient means by which to coat a flat surface with a layer of paint. Unfortunately, such rollers are only capable of spreading a uniform coat of a given paint color across the surface, and cannot be effectively used to create designs or patterns on the surface. In the 1930's custom wall painting techniques, such as rag rolling and sponging become popular as a means to attain a decorative, patterned paint coating on a wall, ceiling or the like. Unfortunately, such techniques generally required a great deal of time and skill to successfully complete, making them unfeasible options for the general public. As a result, those wishing to obtain decorative patterns typically have had to resort to covering their walls with wallpaper. However, wallpaper is also very expensive, and its application requires skills that many people do not possess. Wallpaper is also undesirable because its removal is an arduous process that requires a good deal of time.

In recent years it has once again become popular to use custom wall painting in the decoration of homes. Custom wall painting provides a unique look for a room in a particular house and many times, if the home owner is able, the look achieved is somewhat like wallpaper but is much less expensive than wallpaper. The present techniques are also faster than the application of wallpaper, less materials are required and, therefore, there is less to handle. In addition, when custom painting is used as opposed to wallpaper, there is no need to match rolls of paper from various paint batches nor is there a need for matching seams or a need for excessive amounts of equipment. Two of the more common types of custom wall painting used in home decorating are sponging and rag painting. In many instances a home owner is able to use these two techniques to produce a very professional-looking wall or room. It is has become so popular in fact that sometimes professional painters are hired to apply these techniques to rooms of houses.

Custom wall painting has also become desired for commercial applications in large-scale buildings. The custom wall painting produces a wallpaper effect and is usually cheaper to apply than other wall coverings, such as wallpaper. Even though the current methods for sponge painting and rag rolling a wall or the walls of the room arc much quicker than applying wallpaper, it would be advantageous if there were still quicker methods that could be employed to produce custom wall painting. The current method for sponge painting a wall requires rolling or applying an initial base color to a wall and allowing it to dry. After the wall is dry, a second color is used. A natural sponge is dipped into a second color and then the excess paint absorbed by the sponge is blotted away so that the amount of paint left in the sponge is enough to transfer paint onto the wall yet not enough to produce a solid shape onto the wall. The natural sponge is then used to contact the wall and apply the second color of paint over the base color previously applied. Once the paint within the sponge runs out, the sponge is reinserted into the second color, blotted so the excess paint comes off the sponge and then applied to the wall. This process is repeated until the entire wall or room is painted. Even though this method is faster than applying wallpaper to a room, it still has some problems. First of all, paint is wasted since excessive paint is blotted out of the natural sponge. Secondly, the process is time consuming since a first layer of paint must be applied before the second "sponged" layer of paint is applied to the wall.

Another common home-decorating technique for applying paint is called rag rolling. U.S. Pat. No. 5,471,703 issued to Niven shows a roller having specialized slots therein. The specialized slots receive a rag that is wrapped around the roller and catches or is hooked into the various slots on the roller cover. Paint is applied to the rag and then the roller is used to apply or contact the wall to be painted. Like sponge painting, an initial layer or base layer must be applied to the surface. The initial layer of paint must be allowed to dry before rag rolling the second layer. Rag rolling can also be accomplished by wrapping a rag around a roller, applying paint to the rag and rolling it over a base layer.

Each of these custom wall painting techniques requires the application of a first initial base layer of paint and then one or more additional layers of one or more colors of paint. The process of applying multiple layers of paint to achieve a custom wall paint look is a time-consuming approach as, in many instances, the initial layer of paint must be dry before the next layer can be applied. Alternatively, multiple colors of paint may be applied to a wall simultaneously.

One approach to providing multiple colors of paint is taught in "A Guide to Color & Decorating with Paint," published by Benjamin Moore & Co. of Toronto, Canada. A standard paint tray is provided, and a method for containing multiple colors is described. A piece of cardboard is inserted in the tray while the paint is being poured in, and the cardboard is then removed. However, this approach has several disadvantages. The paint colors may mix due to an uneven resting surface, or from agitation from the roller itself The mixed colors create uneven results on the painted surface. Controlling the cardboard while simultaneously pouring paint is difficult. Further, the cardboard is full of paint when it is removed and creates an additional mess for a painter to deal with. Once the cardboard is removed, the paint tends to mix. Still another disadvantage is that the paint will mix on the roller as it is repeatedly applied to the wall and brought back into the tray. An additional disadvantage is that this method produces a single pattern of a striped wall.

There is a need for new methods of applying paint that are less labor intensive, and which allow for a variety of custom wall-painting effects. There is also a need for an apparatus that can be used by homeowners to apply more than one color simultaneously to the wall. There is still a further need for a roller cover holder that can hold multiple roller covers to keep the colors from mixing on a single roller cover. In addition, there is a need for a process and apparatus that can be used to apply multiple colors to surfaces to be painted such as walls. There is also a need for a painting process which can be adapted for use by commercial painters to produce custom wall finishes quickly and efficiently.

SUMMARY OF THE INVENTION

A roller apparatus for applying paint includes a frame. The frame has a continuous axle on which a first roller cover holder and a second roller cover holder are attached. A spacer is attached to said axle between the first roller cover holder and the second roller cover holder. The spacer maintains a distance between said first roller cover and said second roller cover.

The roller apparatus is used with a multi-well paint pan. The paint pan will have at least as many wells as roller cover holders on the roller apparatus. The paint pan may have more wells than the number of roller cover holders on the roller apparatus. The spacer is small enough so that the roller covers on the roller cover holders are capable of accessing the wells in the paint pan. The spacers also maintain the spacing between the roller covers on the axle of the roller apparatus so that each of the roller covers can be placed in a well of the multi-well paint pan at the same time or substantially simultaneously.

The roller covers used can be fully napped roller covers or can be roller covers that have a pattern therein. The roller apparatus, the multi-well paint pan and the roller covers may be sold altogether in a kit form. Instructional materials, such as videotape or written materials, may be added to the kit.

The invention allows users to apply multiple paint colors simultaneously. The invention allows for a roller apparatus that allows each of the roller covers to rotate at different speeds. Different patterns of roller covers can be used to achieve multiple custom type wall paint applications. Homeowners as well as commercial painters are capable of using the roller apparatus.

DETAILED DESCRIPTION OF THE PREFERRED EMBODIMENT

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
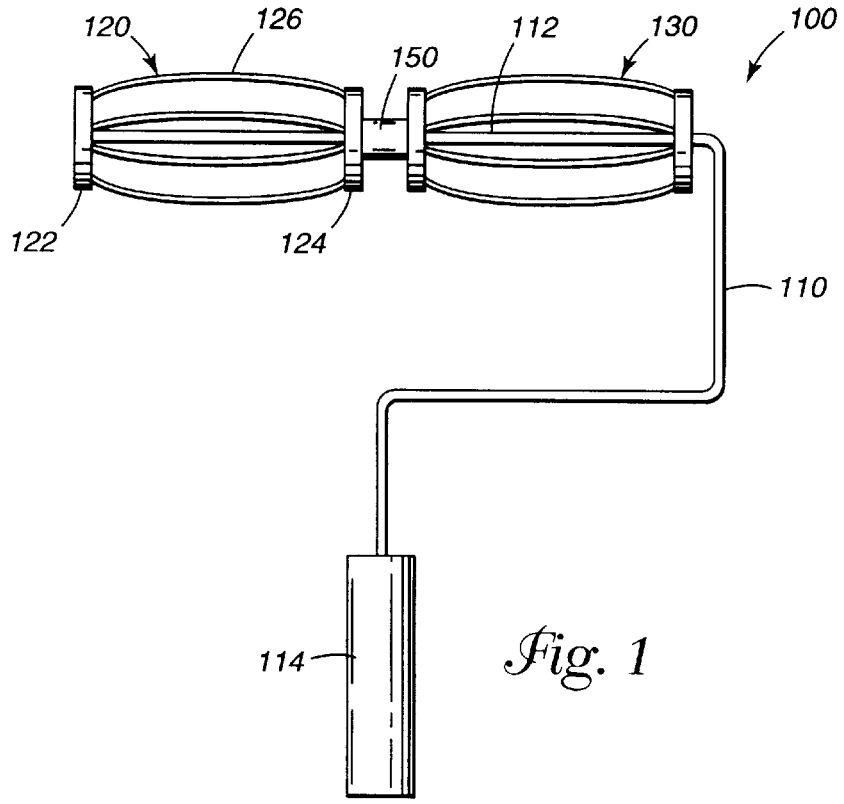
FIG. 1 is a top view of one preferred embodiment of a roller capable of applying more than one layer of paint to a surface.

FIG. 1 is a top view of one preferred embodiment of a roller 100. Roller 100 includes a frame 110. The frame 110 includes an axle 112 and a handle 114. Attached to the axle 112 is a first roller cover holder or roller cage 120 and a second roller cover holder or roller cage 130. Each of the roller cover holders 120, 130 are made of and include a similar set of parts. As a result, the roller cover 120 will be the only one that is discussed in detail. Roller cover 120 includes a first end 122 and a second end 124. Each of the ends 122, 124 includes a bushing or bearing for it which fits axle 112 of the frame 110. The ends 122 and 124 are also disk shaped. The ends 122, 124 have a diameter which is less than the diameter of a roller cover. The roller cover fits over the roller cover holder 120. Between the two ends are a plurality of bowed spring-like members 126. The bowed spring-like members place a friction force on the inside of the roller cover when it fits over the roller cover holder or roller cage 120. Between the first roller cover holder 120 and the second roller cover holder 130 is a spacer 150. The spacer 150 is attached to the axle 112 at a location between the first roller cover holder 120 and the second roller cover holder 130. The spacer 150 can be rotatably attached or merely affixed to the axle 112 of the frame 110. The spacer is of sufficient length so that the first roller cover holder 120 and the second roller cover holder 130 will fit into separate wells in a paint pan. The spacer is also of small enough diameter so that it will not inhibit the roller cover holders 120, 130 from entering the wells of the paint pan. The spacer also has to be dimensioned so that when roller covers are attached to the roller cover holders or roller cages 120, 130 that the roller covers will continue to roll on the surface to be painted.

Figure 2:
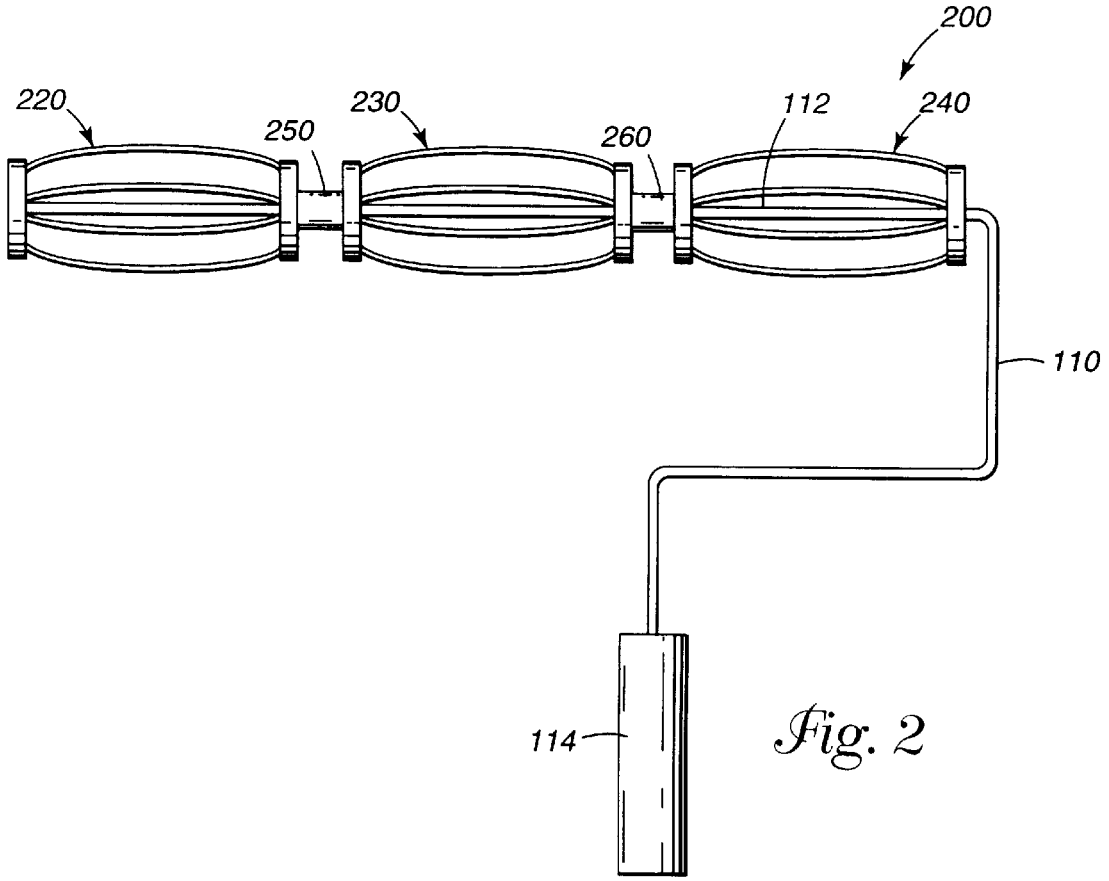
FIG. 2 is a top view of another preferred embodiment of a roller capable of applying more than one layer of paint to a surface.

FIG. 2 shows another roller apparatus 200. The difference between the roller apparatus 200 shown in FIG. 2 and the roller apparatus 100 shown in FIG. 1 is that an additional roller cage and spacer have been added. The roller apparatus 200 includes a frame 110 with an axle 112. Three roller cover holders or roller cages 220, 230 and 240 are rotatably attached to the axle 112. A spacer 250 is attached between roller covers 220 and 230. Another spacer 260 is attached between roller covers 230 and 240. The roller cover holders or roller cages 220, 230 and 240 are dimensioned so that they will fit within a multi-well paint pan and the spacers 250 and 260 are also dimensioned so that the spacing between the roller covers is appropriate and the diameter of the spacers does not interfere with putting the roller 200 into the multi-well pan.

Figure 3:
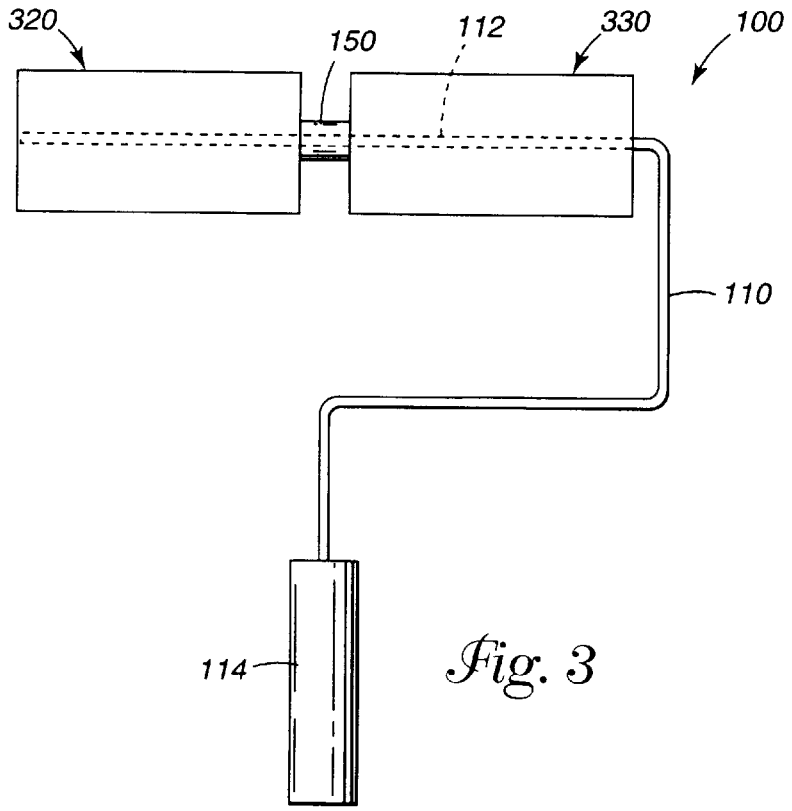
FIG. 3 is a top view of one of the rollers shown in FIG. 1 having roller covers installed thereon.
Figure 4:
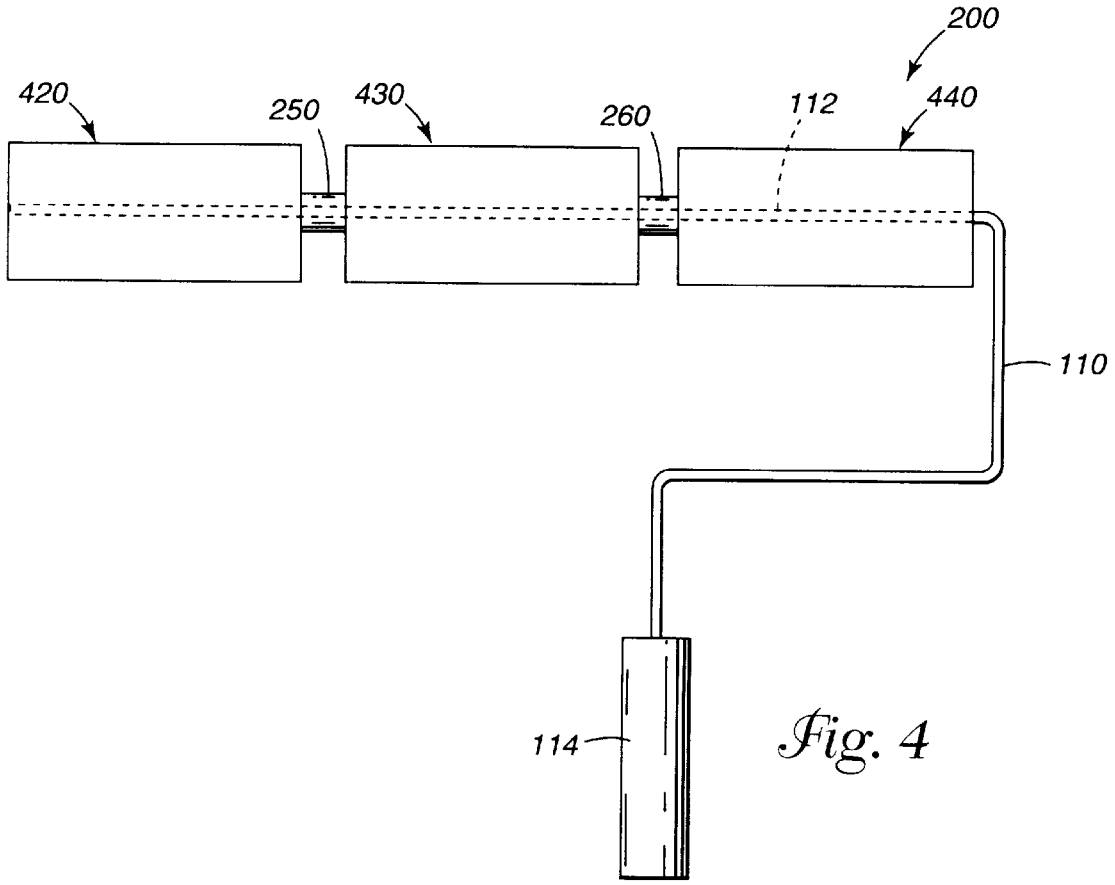
FIG. 4 is a top view of one of the rollers shown in FIG. 2 having roller covers installed thereon.

FIG. 3 shows a top view of the roller apparatus shown in FIG. 1 in which roller covers have been installed. Similarly, FIG. 4 is the roller apparatus 200 with roller covers installed on the roller cages 220, 230 and 240. In both FIGS. 3 and 4, the axle 112 is shown as a dotted line. In FIG. 3, roller covers 320 and 330 have been installed on the roller cages 120 and 130. In FIG. 4, roller covers 420, 430 and 440 have been placed on the roller cages or roller cover holders 220, 230 and 240, respectively. It should be noted that when inserting roller covers onto the roller apparatus 100, the roller cover 330 must be passed over the first roller cage 120 and the spacer 150 before it can be placed on the roller cage or roller cover holder 130. Similarly, in FIG. 4, the roller cover 440 will have to be passed over the roller cover holders or roller cages 220 and 230 before it can be applied to the roller cage 240. Roller cover 430 will have to be passed over roller cage 220 before it can be applied to the roller cage 230.

Figure 5:
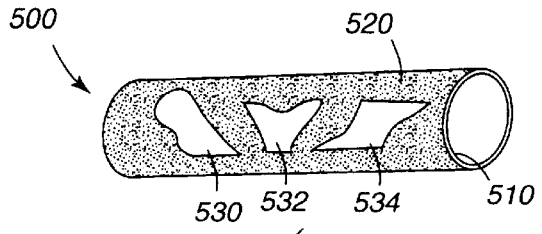
FIG. 5 is a roller cover which has patterns in the nap of a roller.

As shown in FIGS. 3 and 4, the roller covers are smooth or have a nap which is uniform. Now turning to FIG. 5, there is shown a roller cover which has patterns in the nap of the roller. This roller cover 500 can be formed in a variety of ways although it is characterized in that it has a tube 510 to which a nap 520 is attached. The nap is the portion of the roller that holds paint. The nap is noncontinuous or includes patterns such as 530, 532 and 534. These patterned portions as shown in FIG. 5, have no nap associated with them. Other patterns could be formed that have a shortened nap or a lengthened nap. In other words, there are any number of ways to form a patterned roller. The roller apparatus 100 or the roller apparatus 200 can be populated with one or more of these patterned rollers 500. It should also be noted that the pattern shown in FIG. 5 is one of an infinite number of different patterns that could be used to make a custom-painted wall.

Figure 6:
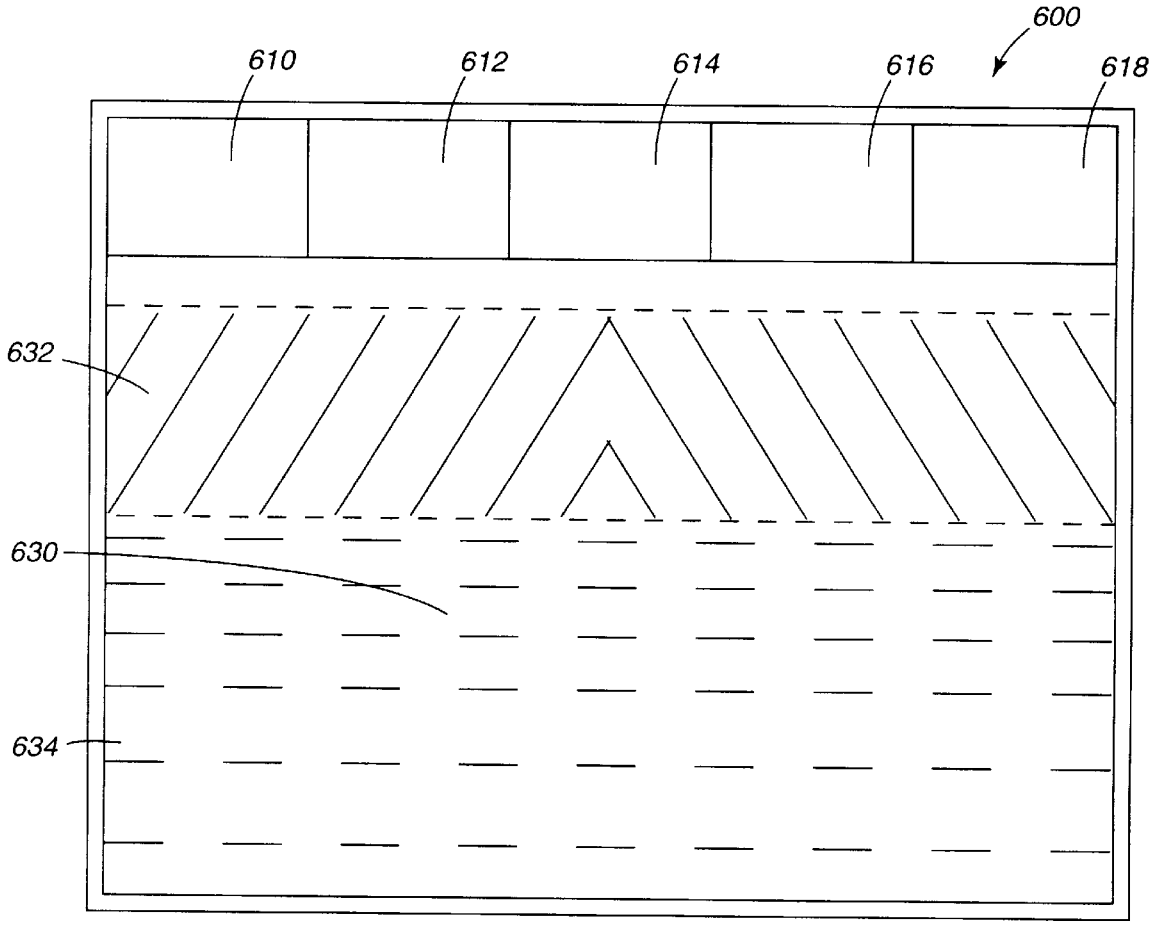
FIG. 6 is a top view of a multiple well paint tray.

FIG. 6 shows a multi-well paint tray 600. On one end of the paint tray 600 there occur a plurality of paint wells 610, 612, 614, 616 and 618. In this particular figure, five paint wells are shown. It should be noted that a multi-chambered paint pan can be formed with any number of wells. It is advisable, however, to have at least as many wells as the number of roller cages on a particular roller apparatus. For example, roller apparatus 200 would require at least a three-chambered or a three-well paint pan. An inclined surface 630 slopes toward the well. The inclined surface includes a portion which has an area for removing excess paint 632 and an area for distributing the paint 634 onto the roller.

In operation, any roller apparatus, such as roller apparatus 100 or roller apparatus 200, can be used with multi-well paint pan 600. Many times a paint pan 600 is sold along with a roller apparatus such as 100 or 200. In this way, the manufacturer can be assured that the spacing between the rollers 420, 430 and 440 is such that they will fit in three adjacent compartments or wells 610, 612, 614, 616 or 618. Different colored paints can be placed in each of the wells 610, 612, 614, 616 and 618. A patterned roller can also be placed upon any one of the roller cover cages 220, 230 or 240. In addition, any or all of the roller cover cages can be outfitted with a patterned roller. The roller is then dipped into three adjacent wells and excess paint is removed and distributed on the surface 630 of the paint pan 600. Once the roller covers are loaded with a proper amount of paint, the operator places the roller apparatus 100 or 200 onto the wall or surface to be painted. The roller is then applied with an arcuate motion or any other motion for that matter that the user desires or selects. Paint from each one of the rollers is then placed onto the wall to produce a custom wall covering. It should be noted that when the roller apparatus 100 or 200 is moved in an arcuate manner or other than straight up and down, the rollers on the outside of the arc are capable of moving along at a faster velocity than the roller covers toward the inside of the arc. In other words, each roller rolls separately from an adjacent roller. The rollers basically then work like a differential on the rear end of an automobile in that the adjacent rollers can move at different velocities. It should also be noted that there is no real limit on the number of rollers that can be placed on an axle 112. In other words, six rollers could be placed on an axle 112 if a multi-chambered or well pan such as 600 would also have to be outfitted with six or more paint wells. There is also no limit on the size of roller cover that can be accommodated by the roller cages such as 120, 130, 220, 230 or 240. In other words, the roller cages can be designed to accommodate nine inch roller covers, four inch roller covers, three inch roller covers, or any dimensioned roller covers. Of course, the dimensions of the paint pan which is used with the rollers is dependent upon the design of the roller apparatus.

It should also be noted that many times a paint pan, such as paint pan 600, and a roller apparatus, such as 200, are sold together as a kit. The kit will generally include a multi-chambered or a multi-welled paint pan such as the one shown in FIG. 6, one or more rollers such as roller apparatus 100 or roller apparatus 200, several roller covers including roller covers which have designs therein and instructional materials such as a video or written instructions. Other paint brushes and comer rollers can also be included in a kit.

As can be seen, this invention or these rollers such as 100 or 200 allow the user to apply multiple paint colors to a surface to be painted. The paint colors can be applied substantially simultaneously. The roller apparatus 100 or 200 also allows each of the roller covers to rotate at a different speed, much like the differential associated with an automobile. Different patterns of roller covers can be used to achieve any number of custom wall paint-type applications which both homeowners or commercial painters can use in home decoration or commercial environments.

Although specific embodiments have been illustrated and described herein, it is appreciated by those of ordinary skill in the art that any arrangement which is calculated to achieve the same purpose may be substituted for the specific embodiments shown. This application is intended to cover any adaptations or variations of the present invention. Therefore, it is manifestly intended that this invention be limited only by the claims and the equivalents thereof.

What is claimed is:

1. A roller apparatus for applying paint comprising:

a frame which includes an axle;

a first roller cover holder attached to said axle and supporting a first roller cover;

a second roller cover holder attached to said axle and supporting a second roller cover; and a spacer having an axial length attached to said axle between the first roller cover holder and the second roller cover holder, said spacer rotatably attached to said axle and said spacer maintaining a fixed distance between said first roller cover and said second roller cover.

2. The roller apparatus of claim 1 wherein the first roller cover holder is rotatably attached to the axle.

3. The roller apparatus of claim 2 wherein the second roller cover holder is rotatably attached to the axle.

4. The roller apparatus of claim 1 wherein the first roller cover holder and the second roller cover holder each comprise a roller cage.

5. The roller apparatus of claim 1 wherein the first roller cover holder and the second roller cover holder each further comprise:

a first end haivng an opening therein;

a second end having an opening therein;

a plurality of bowed wire members connecting said first and second end, said bowed wire members applying a spring force to the inner diameter of respective roller covers to hold the roller covers onto said respective roller cover holders.

6. The roller apparatus of claim 1 further comprising a handle attached to said frame.

7. The roller apparatus of claim 1, further comprising:

a third roller cover holder attached to said axle and supporting a third roller cover, and another spacer having an axial length attached to said axle between said second roller cover holder and said third roller cover holder, said another spacer rotatably attached to said axle and said another spacer maintaining a fixed distance between said second and said third roller covers.

8. A painting apparatus comprising:

a roller apparatus further comprising:

a frame which includes an axle, said frame connected to said axle at one end of said axle;

a first roller cover holder attached to said axle for supporting a roller cover of commensurate axial length to the first roller cover holder;

a second roller cover holder attached to said axle for supporting a roller cover of commensurate axial length to the second roller cover holder; and a spacer having an axial length attached to said axle between the first roller cover holder and the second roller cover holder, said spacer rotatably attached to the axle and said spacer maintaining a fixed distance between said first roller cover and said second roller cover; and a paint tray having;

a first well for holding paint; and a second well for holding paint.

9. The painting apparatus of claim 8 further comprising;

a first cover attached to first roller cover holder; and a second roller cover attached to second roller cover holder.

10. The painting apparatus of claim 9 wherein one of said first roller cover and said second roller cover includes a nap having a pattern therein.

11. The painting apparatus of claim 8 further comprising;

a first roller cover; and a second roller cover, wherein each of said first roller cover and said second roller cover includes a nap having a pattern therein.

12. The painting apparatus of claim 11 further comprising instructional materials used to show how to utilize the painting apparatus.

13. The painting apparatus of claim 8 further comprising a handle attached to said frame.

14. The painting apparatus of claim 8 wherein the axle is continuous, said axle passing through the first roller cover holder and the second roller cover holder.

15. A method for applying paint using a painting apparatus with a first well for holding paint and second well for holding paint, and a roller apparatus further comprising an axle connected to a frame at one end of said axle for holding a first roller cover holder and a second roller cover holder, and a spacer, said spacer rotatably attached to the axle and said spacer maintaining a fixed, spaced apart relation between said first roller cover holder and said second roller cover holder, said method comprising the steps of:

attaching a first roller cover to one of the first roller cover holder and the second roller cover holder, wherein one of the steps of attaching the first roller cover includes passing the first roller cover over the other of first roller cover holder or the second roller cover holder; and attaching a second roller cover to the other of the first roller cover holder and the second roller cover.

16. The method of claim 15 wherein one of the first roller cover or the second roller cover has a nap with a pattern therein.

17. The method of claim 15 further comprising the steps of:

adding paint to the first well; and adding paint to the second well.

18. The method of claim 17 further comprising the steps of:

loading the first roller cover and the second roller cover with paint from the first and second wells; and applying paint to a surface such that the first roller cover holder rotates at an angular rate of speed which is different than the second roller cover holder.

* * * * *